US006289616B1

(12) United States Patent
Alvern

(10) Patent No.: US 6,289,616 B1
(45) **Date of Patent: *Sep. 18, 2001**

(54) MEANS FOR PLACING INFORMATION/ ADVERTISING ON A FUEL DISPENSING NOZZLE OF A PETROL DISPENSING APPARATUS

(75) Inventor: Stein Alvern, Oslo (NO)

(73) Assignee: Alvern Norway A/S (NO)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/911,369

(22) Filed: Aug. 7, 1997

Related U.S. Application Data

(62) Division of application No. 08/284,427, filed on Sep. 6, 1994.

(30) Foreign Application Priority Data

| | | |
|---|---|---|
| Feb. 3, 1992 | (NO) | 920434 |
| Apr. 28, 1992 | (NO) | 921637 |
| May 5, 1992 | (NO) | 931763 |
| Jun. 30, 1992 | (NO) | 922580 |

(51) Int. Cl.[7] ..... B67D 5/00
(52) U.S. Cl. ..... 40/299; 222/23; 141/98
(58) Field of Search ..... 40/299, 661, 609, 40/611, 5; 222/23; 141/392, 98, 206

(56) References Cited

FOREIGN PATENT DOCUMENTS

| | | | | |
|---|---|---|---|---|
| 608596 | * | 8/1994 | (GB) | 40/299 |
| 1-99995 | * | 4/1989 | (JP) | 40/299.01 |

* cited by examiner

*Primary Examiner*—Cassandra Davis
(74) *Attorney, Agent, or Firm*—Finnegan, Henderson, Farabow, Garrett & Dunner

(57) ABSTRACT

An advertising display apparatus on a fluid pump filler gun, such as a fuel pump filler gun at a gas station. The filler gun includes a barrel, a head portion, and a handle. An elongated carrying body, configured to receive an advertising display, attaches to the head portion. The carrying body extends from approximately the junction between the barrel and the head portion, to approximately the connection between the head portion and the handle, providing maximum area for display of the advertisement.

19 Claims, 4 Drawing Sheets

FIG. 1
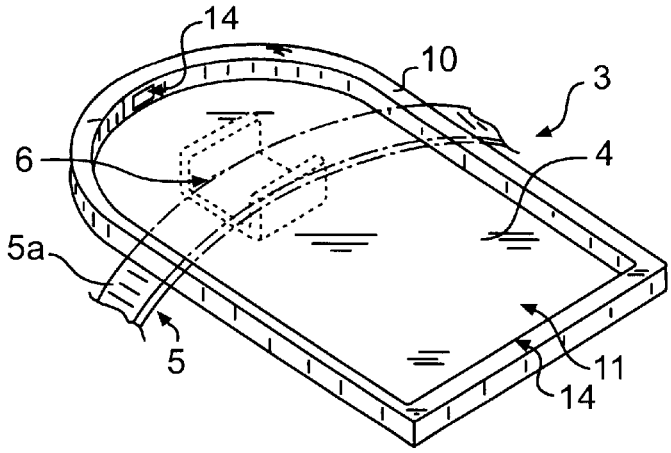
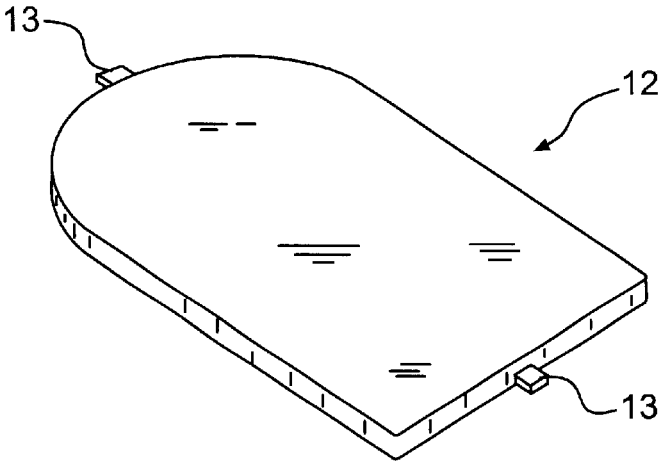
FIG. 2
FIG. 2a
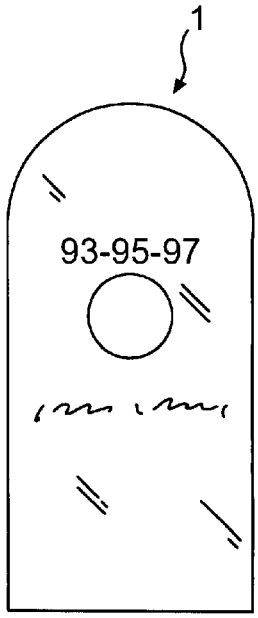

MEANS FOR PLACING INFORMATION/ ADVERTISING ON A FUEL DISPENSING NOZZLE OF A PETROL DISPENSING APPARATUS

This is a division of application Ser. No. 08/284,427, filed Sep. 6, 1994.

FIELD OF THE INVENTION

The present invention relates to a device for placing information/advertising on the filler gun of a fuel pump, comprising a carrying body placed on the head of the gun and having at least one display surface for the information/advertising

BACKGROUND OF THE INVENTION

The affixing of information on the head of a filler gun is known from, for example, U.S. Pat. No. 5,058,637 where a securing means in the form of an elastic stocking is fed onto the filler gun. The stocking is equipped with a display surface for information or advertising, which surface is covered by a transparent cover. The display surface in this known solution is circular and is limited to only a small part of the gun head and the space available for information and/or advertising is limited. The actual method of securing the display surface, which comprises a flexible dead mold cast sleeve, restricts the use of a device of this kind to filler guns which have a special form. This problem can, of course, be solved by manufacturing sleeves of different forms adapted to fit filler guns of different shapes.

SUMMARY OF THE INVENTION

The purpose of the present invention is to provide a device for placing information/advertising on the head of a filler gun and which does not have the disadvantages of a limited display surface referred to hereinabove.

This is achieved according to the present invention by means of an apparatus attachable to the filter gun of a fuel pump of the kind having a conventional gun head with a handle and a gun barrel for displaying on the filler gun one or more graphic messages readily viewable by the user. The apparatus comprises a carrying body which, while attached to the filler gun, extends from approximately the junction of the gun barrel with the gun head to approximately the foremost edge of the handle of the gun head. The carrying body includes a display surface for one or more message, which display surface, when the carrying body is attached to the filler gun, extends longitudinally along the filler gun from approximately the junction of the gun head with the nozzle to approximately the foremost edge of the handle of the gun head. Also, means are provided for detachably securing the carrying body to the filler gun.

A larger display surface, with space for both information and advertising, is thus provided in that the display surface of the carrying body extends over a substantial part of the length of the head of the gun.

As disclosed in the subsequent description of the drawings, the securing component may include an attachment band fixed to the underside of the carrying body by means of suitable means such as adhesives, welding or mechanical fixing wherein the attachment band is fixed to the carrying body by means of an eye/groove provided on the underside of the carrying body.

The attachment band may also be in the form of a hose clip. The attachment band may also consist of two arms which form an integrated part of the carrying body, the ends of the arms being optionally furnished with a barb, and also a through-going screw with nuts being arranged between the carrying body and the gun head, which press the arms against the gun head.

BRIEF DESCRIPTION OF THE DRAWINGS

These and other features of the invention will be described in more detail in the following description of the invention made with reference to the accompanying drawing wherein:

FIG. 1 illustrates a carrying body with a display surface and an attachment band fixed to its underside:

FIG. 2 depicts a transparent cover for mounting on top of an information and advertising sticker positioned on the display surface:

FIG. 2*a* depicts the sticker:

DETAILED DESCRIPTION OF THE PREFERRED EMBODIMENTS(S)

Figure 9:
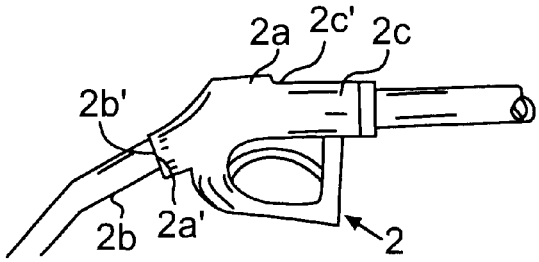
FIG. 9 shows a filler gun seen from the side.
Figure 10:
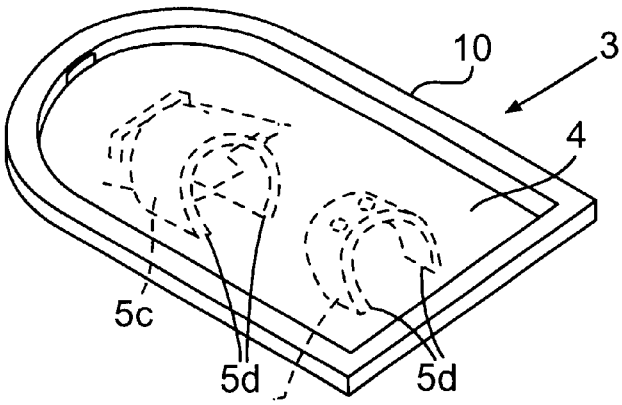
FIG. 10 shows a carrying body with two resilient clamps fixed to the underside thereof.

FIGS. 1 and 2 thus show in perspective view a flat carrying body 3 with a display surface 4 surrounded by an upwardly projecting edge 10, whereby a recess 11 is formed for accommodating information/advertising 1 in the form of a sheet of paper or card of the kind illustrated in FIG. 2*a*. A transparent cover 12 having securing members 13 in the form of projecting lugs can be placed in the recess 11 on top of the information/advertising label 1 and is secured by the lugs being brought into engagement with complementary securing members 14 in the form of openings in the upwardly projecting edge 10. It is shown clearly in the drawing that the carrying body, and thus the sheet containing information/advertising, is elongate, which gives rise to a large display area 4 which extends in the longitudinal direction of the gun head 2*a* approximately from the rear edge 2*b*' of the gun barrel 2*b* at the foremost edge 2*a*' of the gun head 2*a* and backwards to the foremost edge 2*c*' of the handle 2*c* of the gun head 2*a*, see FIG. 9. This display surface 4 can contain clear information regarding, for example, the quality and brand of the fuel on one part, and an advertisment on the other part.

The attachment component 5 of the carrying body 3 comprises an 10 attachment band Sa fixed to the underside of the carrying body 3 by means of an eye/groove 6. The eye/groove 6 may optionally be grooved on the side which faces down towards the filler gun. The attachment band Sa may, of course, optionally be attached to the underside of the carrying body 3 by any kind of means whatsoever such as adhesives or welding. The attachment band 5*a* may consist of a tension adjusting band where one end of the band comprises a leading-in means for securing the other end of the band when it is fed in and tightened. The attachment band Sa can also be made of a hose clip secured to the underside of the carrying body 3. These various forms of attachment bands are designed first and foremost to grip the foremost Dart of the gun head 2*a* or around the barrel 2*b* of the filler gun 2. On moderate tightening of the attachment band, the carrying body will be held secure in the correct position on the head 2*a* of the gun.

The attachment component 5 can, in a special design not shown in the drawing, consist of a sleeve attached to the underside of the carrying body 3 which is designed to be fed onto the gun barrel 2*b* thereby holding the carrying body in a fixed position on the gun head. The sleeve can be elastic thereby being provided with a clamping effect which reinforces the holding effect.

Figure 5:
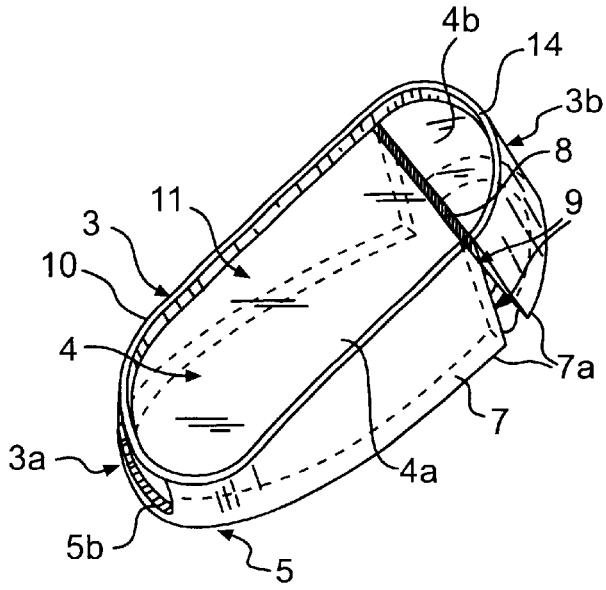
FIG. 5 illustrates the carrying body with a downwardly projecting skirt for enveloping the sides of the gun head and with an opening for interaction with the gun barrel or a sleeve for interaction with the gun barrel.
Figure 6:
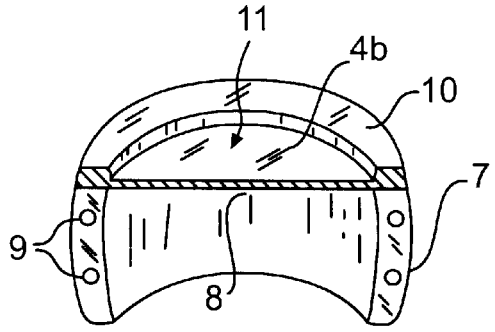
FIG. 6 shows the back of the display surface and the skirt shown in FIG. 5 which is pivotally attached to the front and can be secured in an angular position by securing means.
Figure 7:
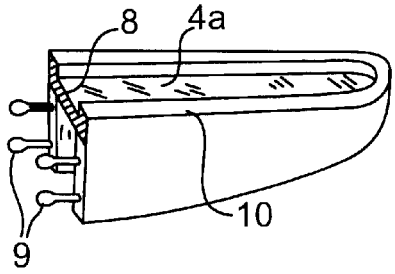
FIG. 7 illustrates the front of the carrying body according to FIG. 5.
Figure 8:
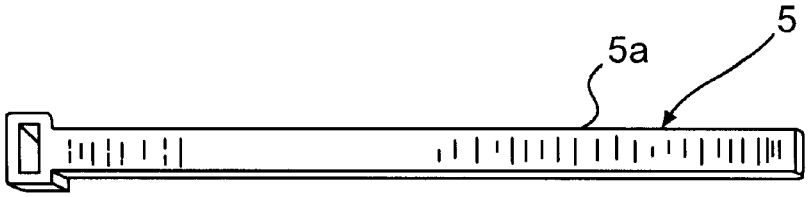
FIG. 8 shows an attachment band of the tension adjusting kind.

The sleeve can be made in a special way as shown in FIGS. 5, 6 and 7 where the carrying body 3 is made with a skirt 7 which projects downwardly from the display surface 4 in order to envelop the sides of the gun head 2*a* and having an opening 5*b*, the function of which corresponds to that of the aforementioned sleeve, which constitutes attachment component 5 in the skirt 7. The opening 5*b* is arranged at one end 3*a* of the carrying body 3 to enable the carrying body to be fed onto the gun barrel 2*b* and optionally onto the foremost end of the gun head 2*a*.

The back 3*b* of the carrying body 3 is attached to the forward part 3*a* thereof so as to be upwardly pivotal via a hinge 8 across the display surface 4. The skirt 7 is split at this point, the split extending from each end of the hinge 8 and out to the edge 7*a* of the skirt and releasable securing members 9 are arranged in the facing splits in the skirt 7. In this way the back 3*b* can be pivoted downwards in the mounted position on the filler gun and interlock with the back of the gun head 2*a*. In this design of the carrying body 3, the display surface will be divided into two surfaces 4*a*,4*b*, each of which can carry appropriate information/advertising. This design of the carrying body 3 thus provides a display surface 4 which extends over a substantial part of the length of the gun head 2*a*.

Figure 3:
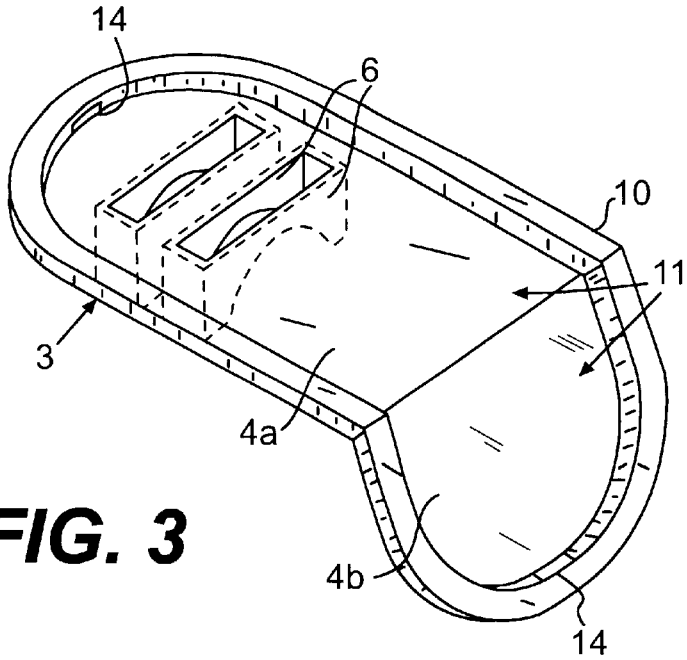
FIG. 3 illustrates a carrying body with two display surfaces angled with respect to each other.
Figure 4:
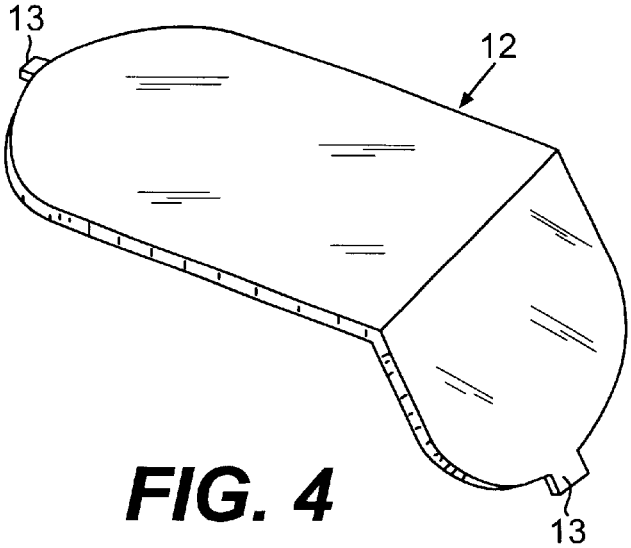
FIG. 4 depicts a transparent cover designed for contact with the whole of the display surface.
Figure 4A:
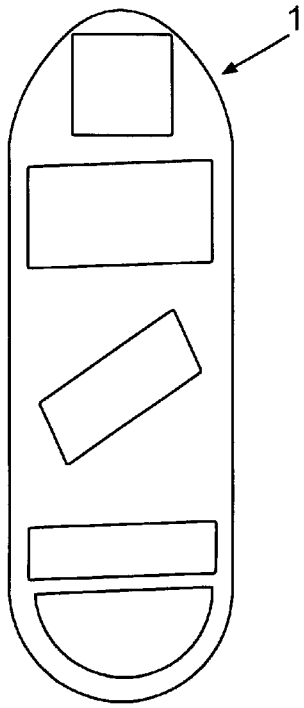
FIG. 4*a* shows an information and advertising sticker adapted to fit the extra long display surface.

A corresponding elongate display surface 4 consisting of two part surfaces 4*a*,4*b* angled with respect to each other is shown in FIG. 3 which illustrates a carrying body with a front part equivalent to the carrying body according to FIG. 1 and having an extension at it rear end, whereby the total display surface 4 comprises a front and a back part 4*a*,4*b* square to one another.

The attachment component 5 can, in an alternative design, consist of a resilient clamp 5*c* made of steel or any other expedient material, secured to the underside of the carrying body 3 with the clamp arms 5*d* projecting outwards from the underside. The carrying body 3 can hereby quite simply be pushed from above onto the filler gun 2 so that the resilient clamp 5*c* grips around the gun barrel 2*b* or gun head 2*a*.

Optionally, the carrying body can be equipped with two resilient clamps 5*c* which grip around each of the two parts of the filler gun 2. The carrying body 3 and the attachment component l, optionally in the form of the skirt 7 with opening 5*b* can be manufactured in an elastic material, eg, in that all parts are dead mold cast in one piece.

Thus the carrying body 3 can be mounted on the filler gun 2 such that the gun barrel 2*b*, or the front part of the gun head 2*b*, is inserted into the attachment component S which has an opening 5*b*. Optionally, the attachment component can be made of the resilient clamp 5*c*, whereby the carrying body 3 quite simply is pressed into place from the top of the gun head.

Advertising/information labels can be attached to the display surface 4 of the carrying body 3 in any expedient manner whatsoever such as by using an adhesive. However, to facilitate changing the labels and at the same time achieve protection of the inform ation/advertising label 1, the solution according to FIGS. 1, 3 and 5 is desirable. The label can hereby be placed in the recess 11 and covered by means of the transparent cover or cover plate 12.

The device according to the present invention will, on use, provide a petrol/fuel customer with clear and full information with regard to th e brand and quality of the fuel. This should prevent a vehicle from being filled with the wrong fuel and thereby save the customer from the problems this would cause and save the petrol station/company from any liability for damages in that the filler gun carries clear information about the fuel quality which the customer could not possibly fail to see. During the actual process of filling his vehicle, the consumer will, at the same time, have ample opportunity to read the advertisement/message that has been affixed to the display surface.

What is claimed is:

1. An advertising display apparatus comprising:

a fluid pump filler gun including in sequence a barrel having first and second ends, a head portion having first and second ends, and a handle having first and second ends, wherein the second end of the barrel connects at a junction with the first end of the head portion, and the second end of the head portion connects with the first end of the handle; and an elongated unitary display carrying body configured to receive an advertising display removably attached to the filler gun and having a front end and a rear end;

wherein the front end of the display carrying body is positioned adjacent the first end of the head portion, and the rear end of the display carrying body is positioned adjacent the second end of the head portion, and wherein said display carrying body includes a downwardly projecting peripheral portion at least partially enveloping sides of the head portion.

2. An advertising display apparatus comprising:

a fluid pump filler gun including in sequence a barrel, a head portion, and a handle, the head portion including a first head portion having an upper surface and a second head portion having an upper surface, the first and second head portions defining an angle therebetween, the first head portion extending from the barrel to the angle, and the second head portion extending from the angle to the handle; and an elongated display carrying body configured to receive an advertising display, removably attached to the filler gun and having a forward carrying body portion and a rear carrying body portion;

wherein the forward carrying body portion covers a portion of the first head portion upper surface, and the rear carrying body portion covers a portion of the second head portion upper surface, and wherein said display carrying body includes a downwardly projecting peripheral portion at least partially enveloping sides of the head portion.

3. An advertising display apparatus comprising:

a fluid pump filler gun including in sequence a barrel having first and second ends, a head portion having first and second ends, and a handle having first and second ends, wherein the second end of the barrel connects at a junction with the first end of the head portion, and the second end of the head portion connects with the first end of the handle; and an elongated display carrying body configured to receive an advertising display, removably attached to the filler gun and having a forward carrying body portion and a rear carrying body portion meeting to define an angle therebetween;

wherein a front end of the display carrying body is positioned adjacent the first end of the head portion, and a rear end of the display carrying body is positioned adjacent the second end of the head portion, and wherein said display carrying body includes a downwardly projecting peripheral portion at least partially enveloping sides of the head portion.

4. An advertising display apparatus comprising:

a fluid pump filler gun including in sequence a barrel having first and second ends, a head portion having first and second ends, and a handle having first and second ends, wherein the second end of the barrel connects at a junction with the first end of the head portion, and the second end of the head portion connects with the first end of the handle;

an elongated unitary display carrying body configured to receive an advertising display and having a front end and a rear end; and means for removably attaching said carrying body to said filler gun;

wherein the front end of the display carrying body is positioned adjacent the first end of the head portion, and the rear end of the display carrying body is positioned adjacent the second end of the head portion, and wherein said attaching means includes a downwardly projecting peripheral portion at least partially enveloping sides of the head portion.

5. An advertising display apparatus comprising:

a fluid pump filler gun including in sequence a barrel having first and second ends, a head portion having first and second ends, and a handle having first and second ends, wherein the second end of the barrel connects at a junction with the first end of the head portion, and the second end of the head portion connects with the first end of the handle;

an elongated unitary display carrying body configured to receive an advertising display removably attached to the filler gun and having a front end and a rear end; and a see-through cover attachable to said display carrying body;

wherein the front end of said display carrying body is positioned adjacent the first end of the head portion, and the rear end of said display carrying body is positioned adjacent the second end of the head portion.

6. An advertising display apparatus comprising:

a fluid pump filler gun including in sequence a barrel, a head portion, and a handle, the head portion including a first head portion having an upper surface and a second head portion having an upper surface, the first and second head portions defining an angle therebetween, the first head portion extending from the barrel to the angle, and the second head portion extending from the angle to the handle;

an elongated display carrying body configured to receive an advertising display, removably attached to the filler gun and having a forward carrying body portion and a rear carrying body portion; and a see through cover attachable to said display carrying body;

wherein the forward carrying body portion covers a portion of an upper surface of the first head portion, and the rear carrying body portion covers a portion of an upper surface of the second head portion.

7. An advertising display apparatus comprising:

a fluid pump filler gun including in sequence a barrel having first and second ends, a head portion having first and second ends, and a handle having first and second ends, wherein the second end of the barrel connects at a junction with the first end of the head portion, and the second end of the head portion connects with the first end of the handle;

an elongated display carrying body configured to receive an advertising display, removably attached to the filler gun and having a forward carrying body portion and a rear carrying body portion meeting to define an angle therebetween; and a see-through cover attachable to said display carrying body;

wherein a front end of said display carrying body is positioned adjacent the first end of the head portion, and a rear end of said display carrying body is positioned adjacent the second end of the head portion.

8. An advertising display apparatus comprising:

a fluid pump filler gun including in sequence a barrel having first and second ends, a head portion having first and second ends, and a handle having first and second ends, wherein the second end of the barrel connects at a junction with the first end of the head portion, and the second end of the head portion connects with the first end of the handle;

an elongated unitary display carrying body configured to receive an advertising display and having a front end and a rear end;

a see-through cover attachable to said display carrying body; and means for removably attaching said display carrying body to the filler gun;

wherein the front end of said display carrying body is positioned adjacent the first end of the head portion, and the rear end of said display carrying body is positioned adjacent the second end of the head portion.

9. The apparatus of claim 1, 2, 3, 4, 5, 6, 7, or 8, wherein said display carrying body extends laterally over the head of said filler gun a distance greater than a width of said filler gun.

10. The apparatus of claim 5, 6, or 7, wherein said carrying body includes a downwardly projecting peripheral portion at least partially enveloping sides of the head portion.

11. The apparatus of claim 1, 2, 3, 4, 5, 6, 7, or 8, wherein said carrying body includes an aperture in a forward end portion through which the barrel removably projects.

12. The apparatus of claim 1, 2, 3, or 4, further comprising a see-through cover attachable to said carrying body.

13. The apparatus of claim 1, 2, 3, 4, 5, 6, 7, or 8, wherein said carrying body is configured to receive a removable advertising display.

14. The apparatus of claim 1, 2, 3, 4, 5, 6, 7, or 8, wherein said carrying body is configured to receive information related to a type of fluid to be pumped by said filler gun.

15. The apparatus of claim 1, 2, 3, 4, 5, 6, 7, or 8, wherein said carrying body leaves the handle uncovered.

16. The apparatus of claim 4 or 8, wherein said attaching means includes an attachment band.

17. The apparatus of claim 8, wherein said attaching means includes a portion projecting downwardly from a periphery of said carrying body at least partially enveloping sides of the head portion.

18. The apparatus of claim 4 or 8, wherein said attaching means includes an aperture defined in said carrying body through which the barrel removably projects.

19. The apparatus of claim 4 or 8, wherein said attaching means includes a clamp projecting from said carrying body.

* * * * *